United States Patent [19]

Ishida

[11] 4,149,313

[45] Apr. 17, 1979

[54] EDGE TOOL

[75] Inventor: Minoru Ishida, Gifu, Japan

[73] Assignee: Feather Safety Razor Co., Ltd., Oyodo, Japan

[21] Appl. No.: 816,988

[22] Filed: Jul. 19, 1977

[30] Foreign Application Priority Data

Aug. 31, 1976 [JP] Japan ..... 51-116745

[51] Int. Cl.[2] ..... B26B 9/02

[52] U.S. Cl. ..... 30/351; 76/104 R

[58] Field of Search ..... 30/258, 339, 356, 357; 76/104 R

[56] References Cited

U.S. PATENT DOCUMENTS

| | | | |
|---|---|---|---|
| 411,568 | 9/1889 | Becker | 76/104 R |
| 3,085,332 | 4/1963 | Raybin | 30/339 |
| 3,166,957 | 1/1965 | Biesma | 76/104 R |
| 3,741,046 | 6/1973 | Chambon | 76/104 R |

*Primary Examiner*—Jimmy C. Peters

*Attorney, Agent, or Firm*—Pollock, Vande Sande & Priddy

[57] ABSTRACT

An edge tool in which a bent portion is formed by bending an edge portion of a blade having a gripping portion and an edge is formed by grinding and polishing the bent portion.

The edge tool has an edge with a high strength, cuts well, enjoys a superior durability, allows the user of the edge tool to produce a desired cutting with great ease, owing to the fact that the user of the edge tool can see the edge easily during the cutting, and can be readily manufactured at a low cost.

4 Claims, 5 Drawing Figures

EDGE TOOL

BACKGROUND OF THE INVENTION

The present invention relates to an edge tool which is used for cutting various articles.

In general, the strength and cutting quality of a conventional edge tool are substantially determined by the properties of the steel of which the edge tool is made.

In the case of conventional edge tools, an acceptable edge tool is obtained only when a certain minimum number of manufacturing steps are used in the manufacture of the edge tool. Needless to say, this can lead to a somewhat high price of the edge tool.

OBJECTS OF THE PRESENT INVENTION

An object of the present invention is to provide an edge tool in which an increased strength of the edge portion and an improved durability of the edge tool are attained by bending the edge portion of an edge tool blank and then grinding and polishing the bent edge portion to form an edge, allowing the user of the edge tool to perform a cutting operation with great ease, due to the fact that the edge is readily seen during the cutting operation, and can be manufactured easily at a low cost.

Another object of the present invention is to provide an edge tool in which the durability of the edge is improved by locating an edge, which is formed by bending the edge portion of an edge tool blank and grinding and polishing the bent edge portion, in a plane different from the plane of the surface of the blade, and/or by providing in the blade an aperture extending lengthwise of the blade, allowing the user of the edge tool to perform a cutting operation with great ease, with the tool being readily manufactured at a low cost, and providing clean cuts due to the small area of contact between the edge and the article.

The subject matter of the present invention is an edge tool in which the edge portion of the blade is bent toward one side of the blade and is ground and polished so that the edge portion consists of a bent portion, a polished portion. An edge, and an aperture is provided in the edge tool which extend lengthwise of the edge tool.

DETAILED DESCRIPTION OF THE PREFERRED EMBODIMENTS

Figure 1:
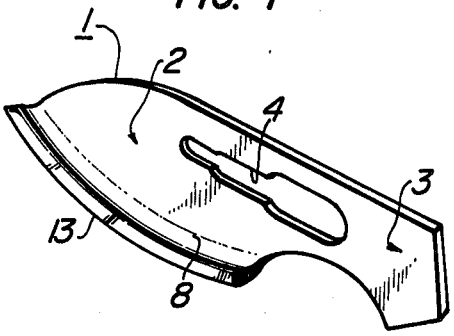
FIG. 1 is a perspective view showing the edge tool according to the present invention.

The following explanation of the preferred embodiments of the present invention will be given with reference to the attached drawings. The numeral 1 indicates an edge tool formed into a required shape, with the edge tool 1 comprising a blade portion 2 and a gripping portion 3. The blade 2 may or may not include an aperture

4, having a cross section in the form of a long and narrow rectangular shape 5, with an edge portion 6 of the blade 2 being bent toward one side surface 7 of the blade 2 and a bent portion 8 being formed. The numeral 9 indicates the other side surface parallel to the one side surface 7 and is formed in the rectangular shaped cross section 3 together with the side surface 7.

An end portion 10 of the bent portion 8 is polished after grinding, so that one side surface of the blade 2 is formed with a polished plane surface 11 which is located in a plane different from the plane of said one side surface 7 or with a polished plane surface 12 which is located in the plane of said one side surface 7. Edges 13 are formed at the end portions 10 of said polished surfaces 11 and 12.

A gripping portion 3 is used as the base of the handle means when a handle (not shown) is attached to the edge tool 1.

The aperture 4 may have any required shape, and extends lengthwise of the edge tool 1.

Figure 2:
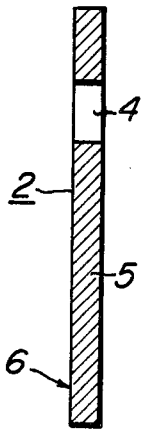
FIG. 2 is an enlarged sectional view illustrating a blade of the edge tool according to the present invention which has bored therein an aperture and is ready to undergo a bending portion.
Figure 3:
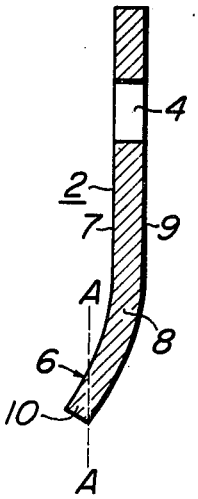
FIG. 3 is an enlarged sectional view showing a blade of the edge tool according to the present invention which has undergone a bending operation.
Figure 4:
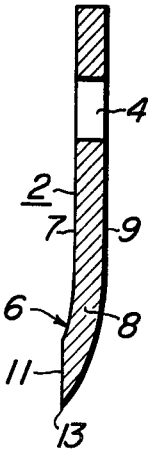
FIGS. 4 and 5 are enlarged sectional views illustrating blades of the edge tool according to the present invention which have undergone polishing operations.
Figure 5:
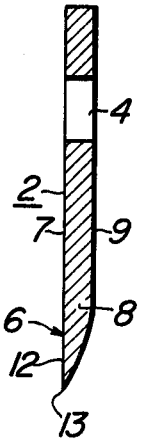

A dotted line A—A shown in FIG. 2 indicates a starting line of grinding and polishing.

In the present invention, by bending the edge portion, a high stength is imparted to the polished plane surface and the edge of the bent portion which constitute the edge portion, so that the cutting quality and durability of the edge are improved.

Since the edge is located at the end of the bent portion and on one side of the bent portion, the edge is readily seen by the user of the edge tool, and a cutting operation is performed with great ease.

When the edge is located in a plane different from the plane of the one side surface, or when an aperture is provided in the edge tool, the cutting quality of the edge tool is improved on account of the fact that the area of the contact between the edge and the article being cut is made small.

The edge tool according to the present invention can be manufactured readily at a low cost thanks to its advantageous feature that only one surface of the blade is ground and polished to form the polished plane surface.

What is claimed is:

1. An edge tool for use in cutting various articles, and comprising:

a tool assembly including a gripping portion and an attached blade portion;

said blade portion having first and second side surfaces extending substantially parallel to one another;

one of said side surfaces being smoothly curved toward the cutting edge of the blade portion of the other of said side surfaces, the other of said side surfaces being ground adjacent said blade cutting edge at an angle substantially parallel to the plane of the remainder of said other side surface, said ground portion of said other side surface intersecting the said one side surface along a line constituting the cutting edge of the blade portion.

2. The edge tool as claimed in claim 1 in which said polished plane surface is located in a plane different from and parallel to the plane of said first side surface of the blade.

3. The edge tool as claimed in claim 1 in which said polished plane surface is located in the same plane of said first side surface of the blade.

4. A method of forming an edge tool for cutting various articles, comprising the steps of:

smoothly curving an end portion of a generally rectangularly-shaped tool blank along a plane extending transversely thereof;

grinding a first, smoothly curved side surface into parallel alignment with said tool blank to form an arcuate edge with a second smoothly curved side surface;

polishing said edge to form an arcuate cutting surface.

* * * * *